US007813933B2

(12) United States Patent
Martin

(10) Patent No.: US 7,813,933 B2
(45) Date of Patent: Oct. 12, 2010

(54) METHOD AND APPARATUS FOR MULTICHANNEL UPMIXING AND DOWNMIXING

(75) Inventor: Geoffrey Glen Martin, Vinderup (DK)

(73) Assignee: Bang & Olufsen A/S, Struer (DK)

( * ) Notice: Subject to any disclaimer, the term of this patent is extended or adjusted under 35 U.S.C. 154(b) by 763 days.

(21) Appl. No.: 11/719,820

(22) PCT Filed: Nov. 21, 2005

(86) PCT No.: PCT/IB2005/053830

§ 371 (c)(1),
(2), (4) Date: May 21, 2007

(87) PCT Pub. No.: WO2006/054270

PCT Pub. Date: May 26, 2006

(65) Prior Publication Data

US 2009/0150163 A1 Jun. 11, 2009

(30) Foreign Application Priority Data

Nov. 22, 2004 (DK) ..... 2004 01816

(51) Int. Cl.
*G10L 19/00* (2006.01)
*H04R 5/02* (2006.01)

(52) U.S. Cl. ..... 704/502; 381/310

(58) Field of Classification Search ..... 704/270, 704/500–504; 381/309, 310
See application file for complete search history.

(56) References Cited

U.S. PATENT DOCUMENTS 3,236,949 A 2/1966 Atal et al.
4,151,369 A 4/1979 Gerzon
5,438,623 A * 8/1995 Begault ..... 381/17
5,862,227 A * 1/1999 Orduna-Bustamante et al. ..... 381/17
7,072,474 B2 * 7/2006 Nelson et al. ..... 381/17
7,113,610 B1 * 9/2006 Chrysanthakopoulos .... 381/309
2004/0086130 A1 5/2004 Eid et al.
2004/0223620 A1 * 11/2004 Horbach et al. ..... 381/59
2004/0234076 A1 11/2004 Agostini
2006/0013419 A1 1/2006 Ko et al.
2006/0045295 A1 * 3/2006 Kim ..... 381/310

FOREIGN PATENT DOCUMENTS

WO WO-2004028204 4/2004

* cited by examiner

*Primary Examiner*—Abul Azad
(74) *Attorney, Agent, or Firm*—Stites & Harbison PLLC; Douglas E. Jackson

(57) ABSTRACT

Loudspeakers in domestic or automotive environments are rarely placed ideally with respect to the sources supplying them, and the stereo and surround images are seldom satisfying. According to the invention there is provided a method and apparatus for combining a precise knowledge about the relative positions of the loudspeakers that were intended (the virtual loudspeakers) and a precise knowledge about the actual placement of listening loudspeakers into a vector space that enables calculation of running corrections to the signals used in order to simulate the presence of the virtual loudspeakers. Specifically the corrections may comprise gain/attenuations determined based on the distances in vector space between the virtual and actual loudspeakers and delays determined from these distances.

12 Claims, 11 Drawing Sheets

METHOD AND APPARATUS FOR MULTICHANNEL UPMIXING AND DOWNMIXING

TECHNICAL FIELD

The present invention relates to methods and products for use in optimising the qualitative attributes of a multichannel sound system.

BACKGROUND OF THE INVENTION

There is a disparity between the recommended location of loudspeakers for an audio reproduction system and the locations of loudspeakers that are practically possible in a given environment. Restrictions on loudspeaker placement in a domestic environment typically occur due to room shape and furniture arrangement. In an automotive environment, loudspeaker placement is usually determined by availability of space rather than optimised listening. Consequently, it may be desirable to modify signals from a pre-recorded media in order to improve on the staging and imaging characteristics of a system that has been configured incorrectly.

There is an increasing number of audio formats employing a number of different channel configurations. Until recently, only one-channel and two-channel media were available to consumers. However, the introduction of distribution media such as DVD-Video, DVD-Audio, and Super-Audio CD has made multichannel audio commonplace in domestic and automotive systems. This has meant, in many cases that there is a mismatch between the number of loudspeakers in a listening environment and the number of channels in the media. For example, it frequently occurs that a listener has only two loudspeakers but 5 channels of audio on a medium. The converse case also exists where it is desirable to play two-channel program material distributed over more than two loudspeakers. Consequently algorithms are constantly being developed in order to adapt media from one format to another. Downmix algorithms reduce the number of audio channels and upmix algorithms increase the number.

Standard recommendations for domestic and automotive sound reproduction systems state that all loudspeakers should not only be placed correctly but have matched characteristics (i.e. ITU-R BS-775). However, in typical situations, this ideal requirement is rarely met. For example, in a domestic environment, it is often the case that the built-in audio system of a television is used for the centre channel of a surround sound system. This speaker rarely matches the larger, exterior loudspeakers used for the front left and right channels. In addition, it is typical for the surround speakers to be smaller as well. Consequently, the audio signals produced by these different loudspeakers differ too much for a cohesive sound field to be created in the listening environment. Therefore, it is desirable that these differences be minimised in order to give the impression of matched loudspeaker characteristics.

The tuning of high-end automotive audio systems is increasingly concentrating on the imaging characteristics and "sound staging." It is a challenge to achieve staging similar to that intended by the recording engineer (as is possible in a domestic situation) due to the locations of the various loudspeakers in the car. It is therefore desirable that an automatic method of choosing delay and gain parameters for the various loudspeaker drivers in an automotive environment be developed to provide a "starting point" for tuning of the car's playback system.

SUMMARY OF THE INVENTION

On the above background it is an object of the present invention to provide a method and corresponding system for reduction of the number of audio channels, whereby multiple audio channels recorded on a suitable medium (for instance 5 channels in a surround sound recording) can be played back over a lesser number of loudspeakers (for instance 2 loudspeakers in a traditional stereophonic set-up).

It is a further object of the present invention to provide a method and corresponding system for increasing the number of audio channels, whereby for instance 2 stereophonic audio channels can be played back over a larger number of loudspeakers (for instance over 5 loudspeakers as in a standard surround sound set-up).

The two procedures outlined above are referred to as a Downmix algorithm/method/system and an Upmix algorithm/method/system, respectively, as mentioned initially.

It is a specific object of the present invention to provide a method and corresponding systems by means of which the acoustic imaging characteristics and "sound staging" similar to or at least approximating that intended by the recording engineer can be achieved by the loudspeakers in a car or other confined environment.

It is a further object of the present invention to provide a method and corresponding system, which enables an end user to control the apparent "width" or "surround" content of an audio presentation.

In addition, by manipulating the locations of the virtual sound sources created by the method and system of the invention, the entire sound field can be rotated around the listener, or the virtual "sweet spot", i.e. the optimal listening position can be moved to any desired location.

It is a still further object of the present invention to provide a method and corresponding system which can be used to simulate the differences in the frequency-dependent directivity patterns of the virtual loudspeakers (i.e. the imaginary loudspeakers simulated by the use of the method and system according to the invention) and the real loudspeakers, for instance the loudspeakers actually installed in the cabin of a vehicle.

These and other objects are according to the invention attained by a method for individually controlling the outputs from a number of pre-located loudspeakers as to magnitude and time delay of signal components emitted from these loudspeakers by conversion of a set of input signals intended for a different number and configuration of virtual loudspeakers, according to which method the pre-located and virtual loudspeakers are placed in a vector space, and where each particular pre-located loudspeaker is supplied with a signal that is obtained as the linear sum of the input signals to the virtual loudspeakers, these signals being provided with individually determined magnitude and time delays, where the magnitudes and delays are calculated by using the vectorial distances between each of the virtual loudspeakers and the particular pre-located loudspeaker.

The method and system according to the invention can be used as an algorithm for correction of loudspeaker placement, an n-to-m channel upmix algorithm or an n-to-m channel downmix algorithm.

Thus, according to the invention there is provided a method for converting a first number of signals to a second number of signals such as upmixing or downmixing n input signals to m output signals, where each of said output signals ($o_1$, $o_2$, $o_3$, . . . $o_m$) is obtained as the sum of processed signals ($o_{11}$, $o_{12}$ . . . $o_{nm}$). where each of said processed signals is obtained by processing corresponding input signals ($i_1$, $i_2$, . . . , $i_n$) in processing means having a transfer function $H_{ij}$ or an impulse response $h_{ij}$, where the transfer function may be a function of frequency.

According to a specific embodiment of the invention, there is provided a method of the above kind for individually controlling output signals ($o_1$, $o_2$, $o_3$, . . . $o_m$), which are to be provided to a number of pre-located real sound sources by conversion of a set of input signals ($i_1$, $i_2$, . . . $i_n$) intended for a different number and configuration of virtual sound sources, where the pre-located real sound sources and the virtual sound sources are located or represented in a vector space, and where each particular pre-located real sound source is provided with a signal ($o_1$, $o_2$, $o_3$, . . . $o_m$) that has a magnitude and time delay obtained as a linear sum of at least some of said input signals intended for the virtual sound sources, and the magnitudes and delays of the signal ($o_1$, $o_2$, $o_3$, . . . $o_m$) to be provided to a particular one of said real sound sources are calculated by using the vectorial distances between each of the virtual sound sources and the particular pre-located sound source.

According to the above embodiment of the invention, the signal sent to a given loudspeaker is created by summing all input channels from the playback medium with each input channel assigned an individual delay and gain. These two parameters are calculated using the relationship between the desired locations of the loudspeaker(s) and the actual location of the loudspeaker(s). For example, FIG. 4 shows the desired locations of five loudspeakers (hereafter labelled "virtual" loudspeakers) for a multi channel audio reproduction system. In addition, one of the actual loudspeakers is shown. The distance between each of the virtual loudspeakers and the real loudspeaker is calculated. This can be done using an X, Y, Z coordinate system where the virtual and the real worlds are considered on the same scale using the equation:

$$d=\sqrt{(X_v-X_r)^2+(Y_v-Y_r)+(Z_v-Z_r)^2}$$

where d is the distance between the real and virtual loudspeakers, ($X_v$, $Y_v$, $Z_v$) is the location of the virtual loudspeaker in a Cartesian coordinate system, and ($X_r$, $Y_r$, $Z_r$) is the location of the real loudspeaker. All variables are assumed to be on the same scale.

The distance between a given virtual loudspeaker and a given real loudspeaker is used to calculate a gain and delay corresponding to the gain and delay naturally incurred by propagation through that distance in a real environment. The delay can be calculated using the equation $$D = \frac{d}{c}$$

where D is the propagation delay to be simulated, d is the calculated distance between the virtual and real loudspeakers and c is the speed of sound in air.

The gain to be applied to the signal is typically attenuation, and is also determined by the distance between the real and virtual loudspeakers. As an example, this can be calculated using the equation $$g = \frac{1}{d}$$

where g is gain applied to the signal simulating attenuation due to distance.

Alternatively, the gain calculation could be based on sound power rather than sound pressure attenuation over distance.

The above gain/attenuation g is independent on frequency, but it is also possible according to the invention to apply a frequency-dependent g-function, i.e. g(f). By applying g(f) for instance, frequency-dependent directional characteristics of the virtual sound sources may be accounted for, and it is furthermore possible to introduce perceptual effects of the open ear transfer function of the human ear, this function being generally a function of both frequency and angle of sound incidence from the virtual sound source to the position of the listener. An illustrative example will be given in the detailed description of the invention. In this generalised case (both relating to directional characteristics of the virtual sound sources and to the incorporation of HRTF's), the function g will depend on both direction of sound incidence from a given sound source to the listening position, this direction being denoted by the vector R, and on the frequency, i.e. g as mentioned above will be replaced by (R, f).

According to the invention, there is furthermore provided an apparatus for performing a conversion or upmix/downmix operation comprising:

(a) n input terminals for receiving input signals ($i_1$, $i_2$, . . . $i_n$) from a suitable input source;

(b) processing means ($H_{11}$, $H_{12}$ . . . $H_{nm}$) for processing corresponding input signals ($i_1$, $i_2$, . . . $i_n$), whereby each of the processing means provides a processed output signal ($o_{11}$, $o_{12}$ . . . $o_{nm}$);

(c) m summing means for providing m output signals ($o_1$, $o_2$, $o_3$, . . . $o_m$);

where each of said summing means can be provided with processed output signals ($o_{11}$, $o_{12}$ . . . $o_{nm}$) corresponding to each of said input signals ($i_1$, $i_2$, . . . $i_n$).

According to a specific embodiment of the apparatus according to the invention each of said processing means ($H_{11}$, $H_{12}$ . . . $H_{nm}$) comprise delay means or gain means, or both delay means and gain means, whereby each of said processed output signals ($o_{11}$, $o_{12}$, $o_{13}$, . . . $o_{nm}$) will be a delayed version of the corresponding input signal or an amplified or attenuated version of the corresponding input signal or a delayed and amplified or attenuated version of the corresponding input signal.

According to a specific embodiment of the Invention, said apparatus comprises:

(a) a data register for storing location coordinate information for each of a set of pre-located loudspeakers and for each of a set of virtual loudspeakers;

(b) a series of A/D converter means for receiving input signals corresponding to the virtual loudspeakers and converting them to a digital representation;

(c) means for determining the numerical vectorial distance between each of the virtual loudspeakers and a particular pre-located loudspeaker;

(d) means for storing said numerical vector distances in an intermediate result matrix;

(e) division means for determining the corresponding delays (D) by dividing the numerical vectorial distance by the speed of sound in air (c);

(f) means for determining the corresponding gains (g) by taking the reciprocal of said numerical vector distances;

(g) multiplier means for multiplying each of said input signals by the corresponding gain (g) and adder means for adding the corresponding delay (D); and (h) summing means for adding the processed signals corresponding to each virtual loudspeaker to obtain a signal to a D/A converter, whereby an output signal ($o_1, o_2, \ldots o_m$) for each of said pre-located loudspeakers is provided.

If the input source provides digital output signals, the series of A/D converter means mentioned under item (b) above can of course be omitted. Furthermore, if "digital" loudspeakers with digital amplifiers (for instance class-D amplifiers) are used, the D/A converter mentioned under item (h) above can also be omitted.

The present invention furthermore relates to the use of the inventive method and apparatus for supplying a set of automotive loudspeakers with signals corresponding to a home entertainment environment.

The method and apparatus according to the invention can for instance be used in domestic sound reproduction systems and automotive sound reproduction systems.

The methods can give listeners the impression that loudspeakers are correctly placed in configurations where this is not the case.

The methods can be used as a matrix that translates any desired number of channels in the distribution or playback media (i.e. 2-, 5.1-, 7.1-, 10.2-channels etc. . . . ) to any number of loudspeakers.

The methods can be used to minimise the apparent differences between loudspeakers in domestic, automotive sound systems or for sound reproduction systems in yachts.

The methods can be used to produce a suggested tuning of delay and gain parameters for instance for domestic sound systems, automotive audio systems or for sound reproduction systems in yachts.

BRIEF DESCRIPTION OF THE DRAWINGS

The present invention will be more fully understood with reference to the following detailed description of embodiments of the invention and with reference to the figures.

DETAILED DESCRIPTION OF THE INVENTION

The proposed system can be used as an n-to-m channel upmix algorithm or an n-to-m channel downmix algorithms i.e. as an algorithm for correction of loudspeaker placement.

The methods can furthermore be used as a matrix that translates any desired number of channels in the distribution or playback media (i.e. 2-, 5.1-, 7.1-, 10.2-channels etc. . . . ) to any number of loudspeakers.

Figure 1:
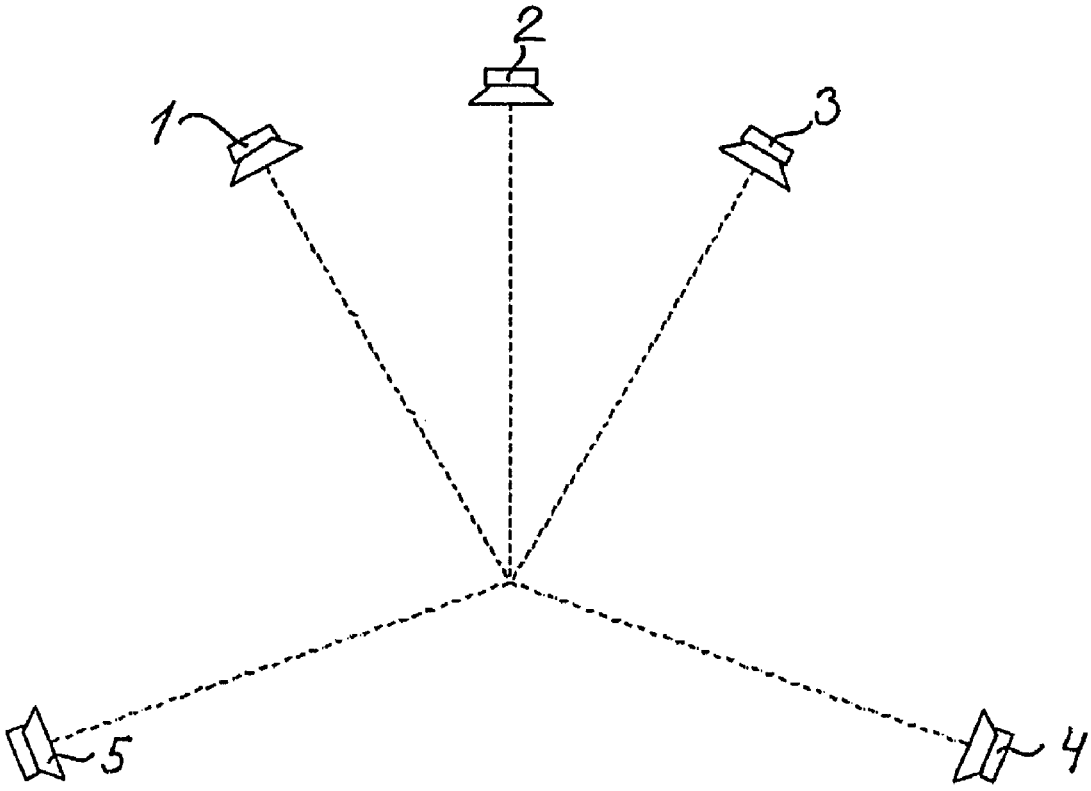
FIG. 1. Example of a standard loudspeaker configuration. This particular example is for a 5-channel system following the ITU-BS.775 recommendation.
Figure 2:
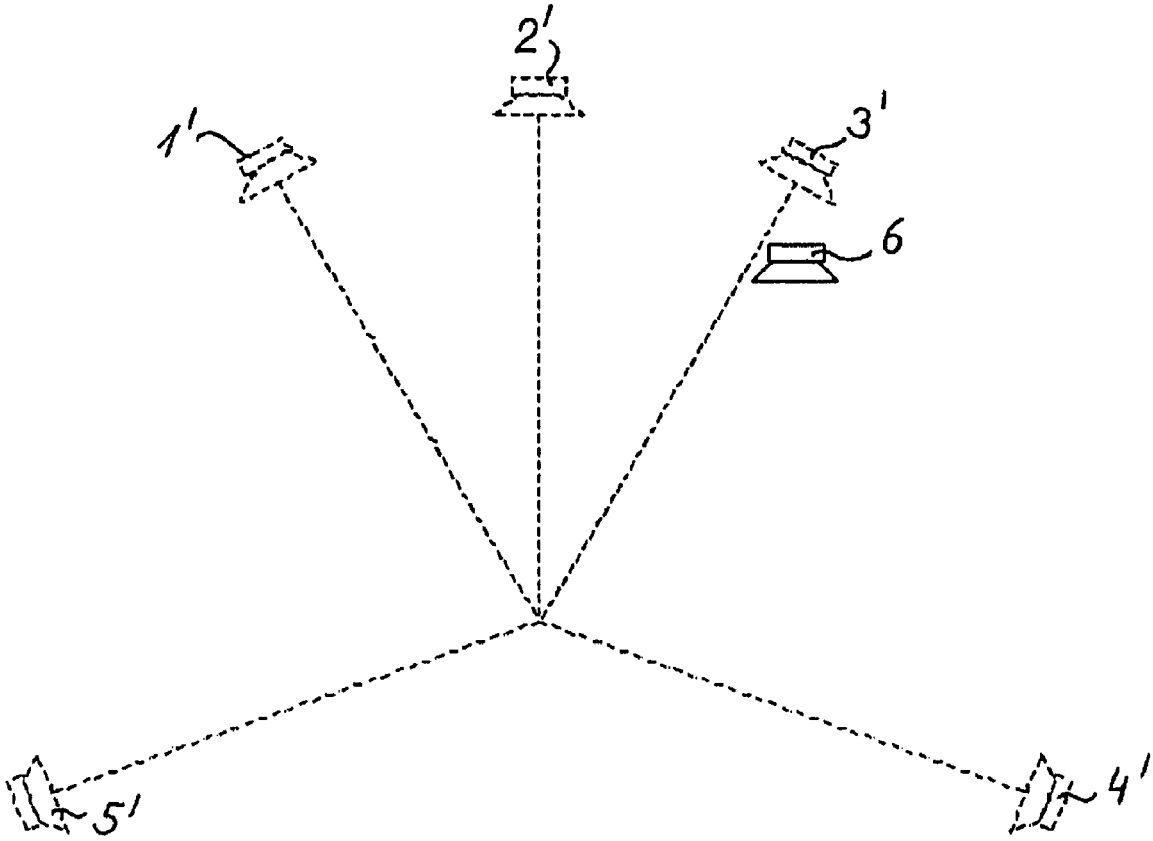
FIG. 2. Example showing the relationship between the desired loudspeaker locations (shown in dotted lines) and the actual location of one loudspeaker (solid lines) in a listening environment.
Figure 3:
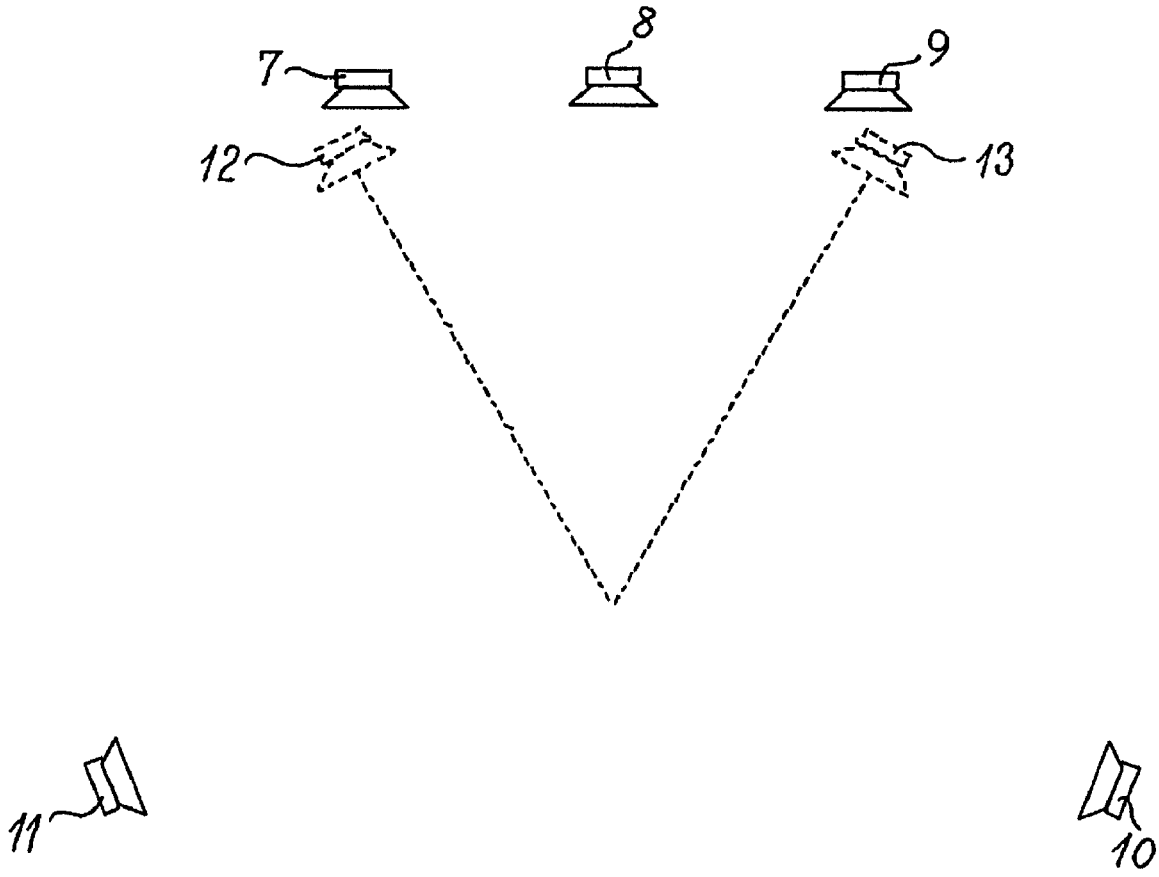
FIG. 3. Example showing the relationship between the two desired loudspeaker locations (shown in dotted lines) and the actual location of five loudspeakers (solid lines) in a listening environment.

The method and apparatus according to the invention can be regarded as a method/apparatus for reproducing a given number (n) of virtual sound sources (loudspeakers) by means of a different number (m) of actual physical sound sources (loudspeakers). Thus, for instance the standard loudspeaker configuration shown in FIG. 1, i.e. a 5-channel system following the ITU-BS.775 recommendation can be simulated using the method and apparatus according to the invention. In this case, the five actual loudspeakers indicated by reference numerals 1 through 5 in FIG. 1 are regarded as corresponding virtual loudspeakers 1' through 5' as shown in FIGS. 2, 4, 7, 9 and 10 (shown in dotted lines in FIG. 2), and these virtual loudspeakers are replaced by a different number of actual physical loudspeakers, of which only one is shown in FIG. 2 indicated by reference numeral 6. If the number of actual loudspeakers is less than the number of virtual loudspeakers, a downmix procedure is performed. An upmix procedure could consist of a replacement of two virtual loudspeakers 12 and 13 being replaced by five actual loudspeakers 7, 8, 9, 10 and 11 as shown in FIG. 3.

Figure 4:
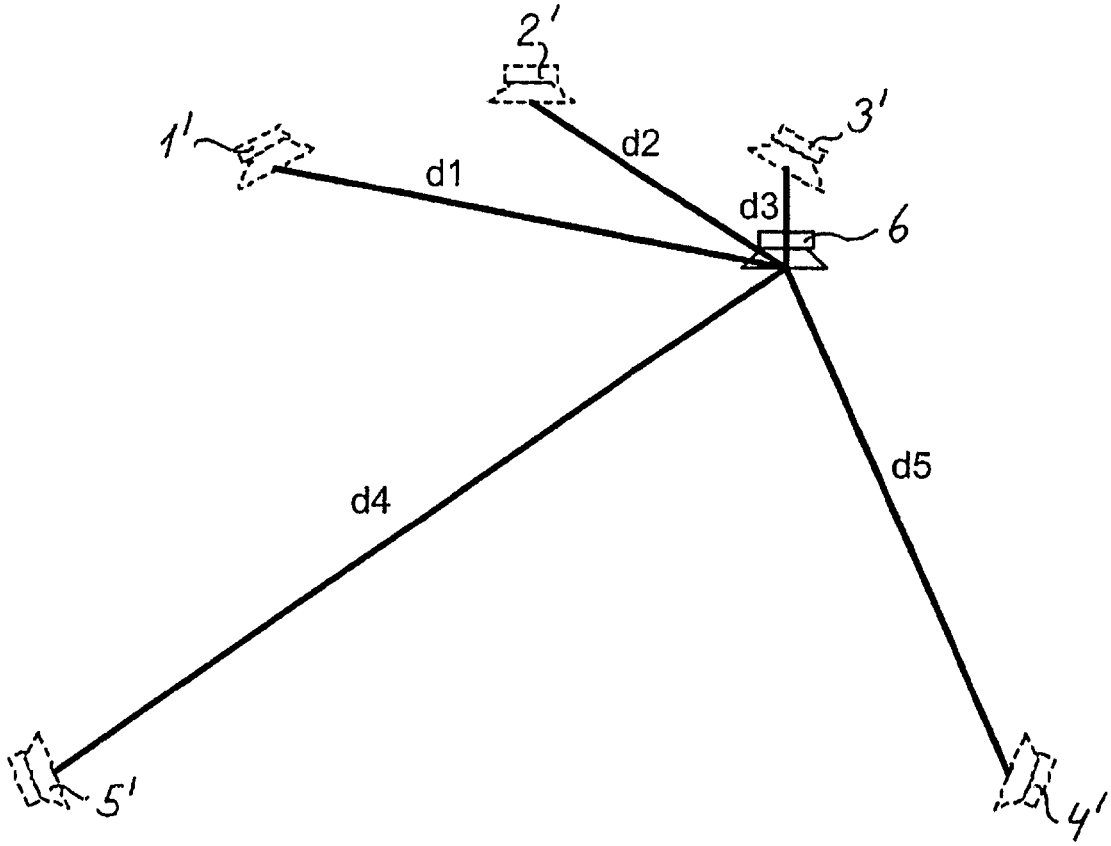
FIG. 4. Example of the calculation of the distances between the desired locations of the loudspeakers and the location of the real loudspeaker.

According to an embodiment of the invention the signal sent to a given loudspeaker is created by summing all input channels from a playback medium with each input channel assigned an individual delay and gain. These two parameters are calculated using the relationship between the desired locations of the virtual loudspeaker(s) and the locations of the actual loudspeaker(s). For example, FIG. 4 shows the desired locations of five virtual loudspeakers 1', 2', 3', 4' and 5' for a multi channel audio reproduction system. In addition, one of the actual loudspeakers 6 is shown. The distance $d_1$ through $d_5$ between each of the virtual loudspeakers 1', 2', 3', 4' and 5' and the real loudspeaker 6 is calculated. This can be done using an X, Y, Z coordinate system where the virtual and the real worlds are considered on the same scale using the equation:

$$d=\sqrt{(X_v-X_r)^2+(Y_v-Y_r)^2+(Z_v-Z_r)^2}$$

where d is the distance between the real and virtual loudspeakers, ($X_v$, $Y_v$, $Z_v$) is the location of the virtual loudspeaker in a Cartesian coordinate system, and ($X_r$, $Y_r$, $Z_r$) is the location of the real loudspeaker. All variables are assumed to be on the same scale.

The distance between a given virtual loudspeaker and a given real loudspeaker is used to calculate a gain and delay corresponding to the gain and delay naturally incurred by propagation through that distance in a real environment. The delay can be calculated using the equation $$D = \frac{d}{c}$$

where D is the propagation delay to be simulated, d is the calculated distance between the virtual and real loudspeakers and c is the speed of sound in air.

The gain to be applied to the signal is typically attenuation, and is also determined by the distance between the real and virtual loudspeakers. As an example, this can be calculated using the equation $$g = \frac{1}{d}$$

where g is the gain applied to the signal simulating attenuation due to distance.

Figure 5:
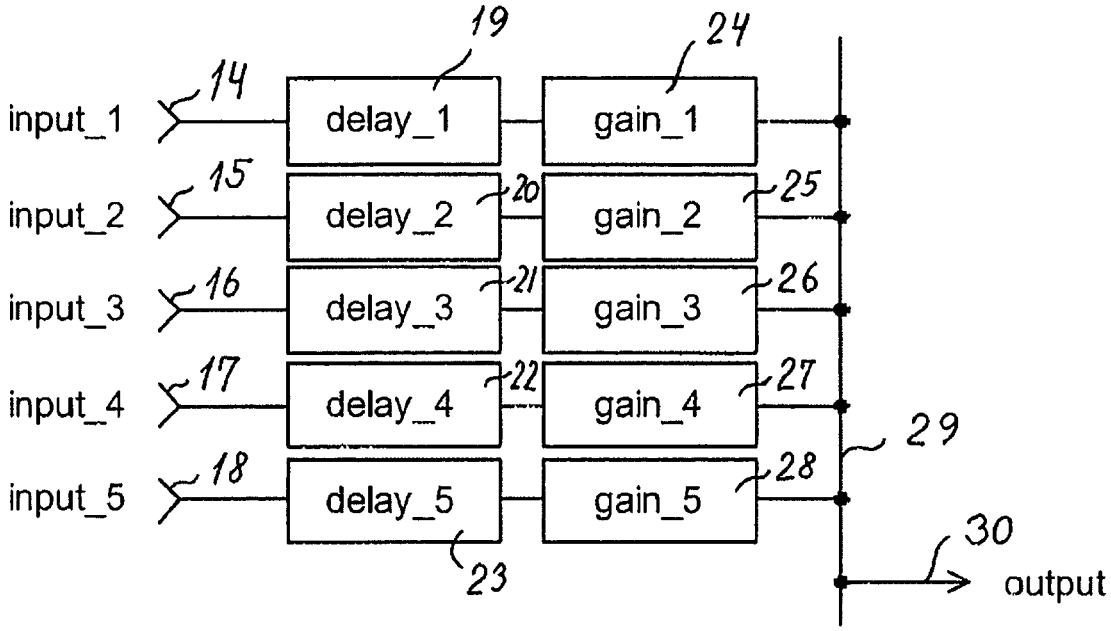
FIG. 5. Example implementation of the algorithm required to generate an output for the real loudspeaker shown in FIG. 4 using the calculated distances d1 through d5. The vertical line indicates a mixing bus where all signals arriving from the left are added and sent to the output on the right.

An apparatus corresponding to the situation shown in FIG. 4 is shown in FIG. 5, where the signals on each of the 5 separate input channels 14, 15, 16, 17 and 18 are subjected to individually determined delays 19, 20, 21, 22 and 23 and corresponding gains 24, 25, 26, 27 and 28 determined by the above equations. The thus processed input signals are summed as indicated by 29, whereby the output signal 30 for the real loudspeaker 6 (FIG. 4) is obtained.

Figure 6:
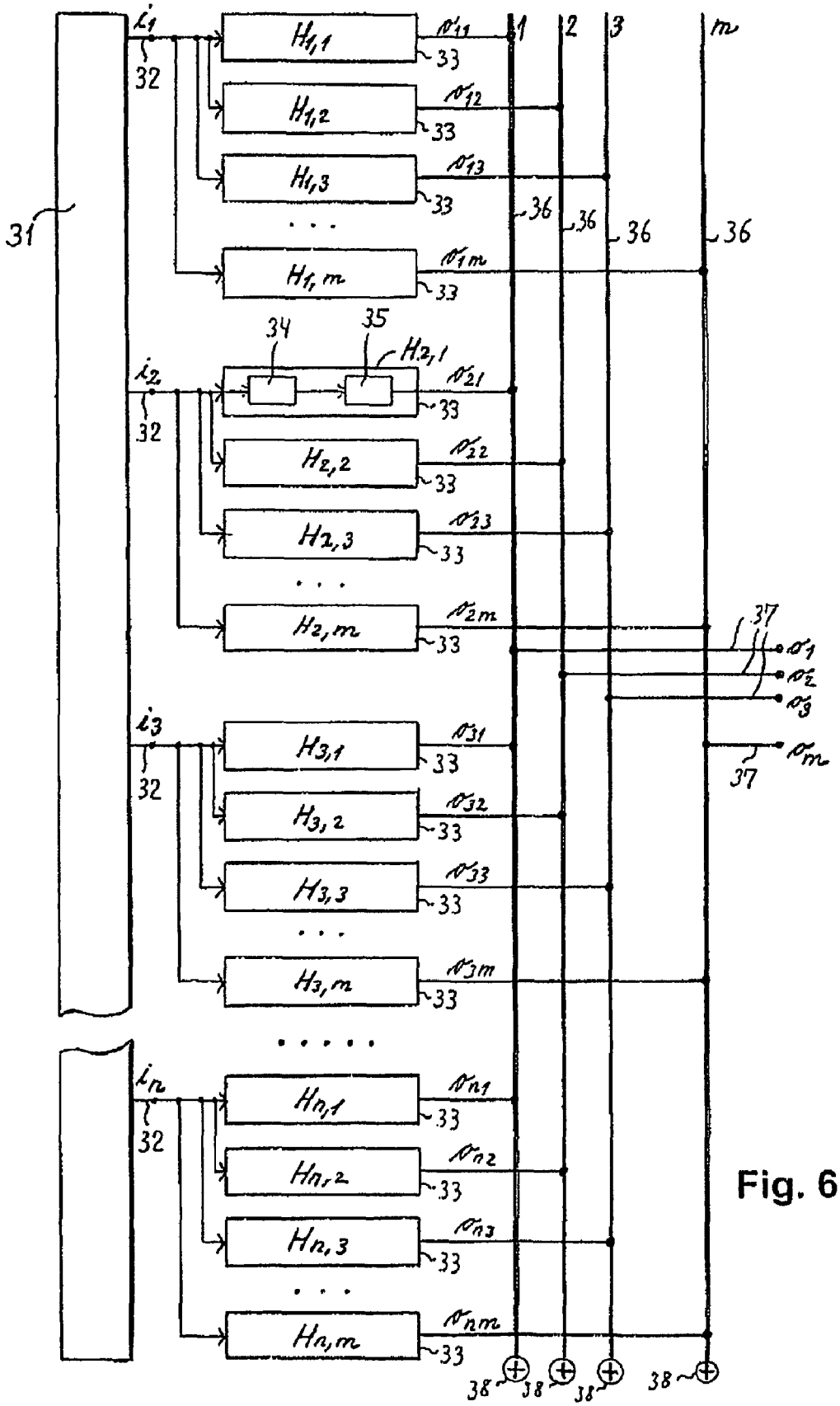
FIG. 6. A generalised diagrammatic representation of the apparatus according to the invention for converting n input channels to m output channels.

With reference to FIG. 6 there is shown a generalised diagrammatic representation of the apparatus according to the invention for converting n input channels to m output channels. A multi channel source, for instance a CD or DVD player 31 is providing n output signals corresponding to n channels of audio as input signals ($i_1, i_2, \ldots, i_n$) to a block of processing means, in the implementation shown in FIG. 6 comprising a total of n×m processing means 33, which may be defined by transfer functions ($H_{11}, H_{12} \ldots H_{nm}$) or corresponding impulse responses h(ij). According to a specific embodiment of the invention, the processing means 33 comprises delay means 34 and gain means 35. From each of the processing means, processed output signals ($o_{11}$, $o_{12}$, $o_{13}, \ldots o_{nm}$) are provided and these output signals are provided to a total of m summing means 36, one for each output channel, i.e. real loudspeaker, for providing m output signals 37, where the first of said summing means 36 is provided with processed output signals ($o_{11}, o_{21} \ldots o_{n1}$) corresponding to each of said input signals ($i_1, i_2, \ldots, i_n$), etc.

Figure 7:
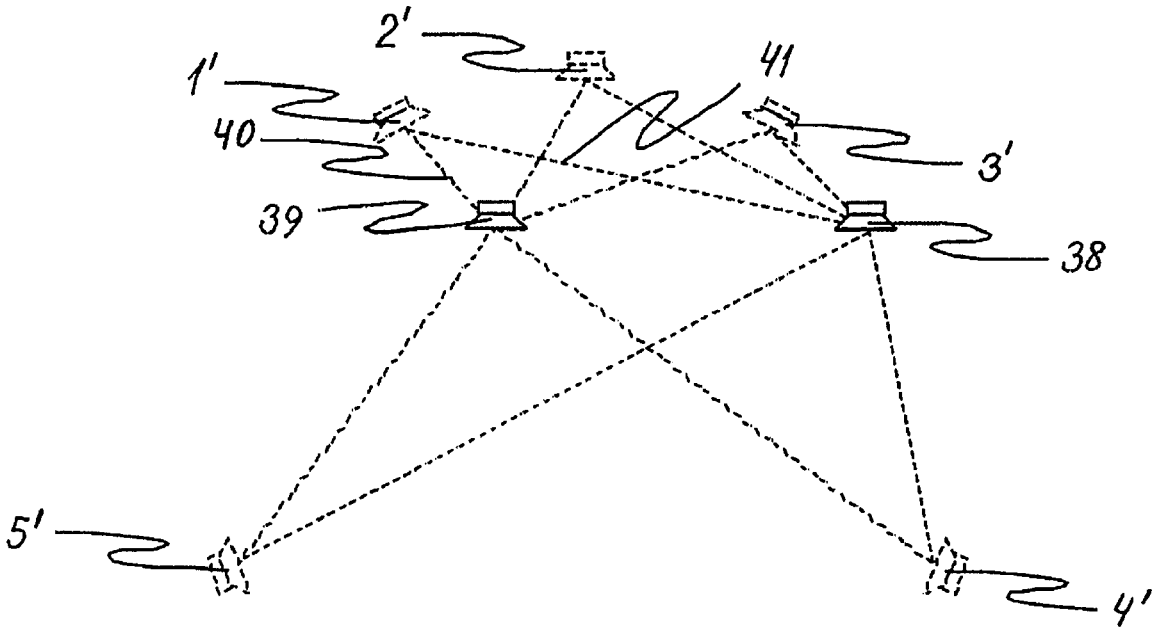
FIG. 7. An embodiment of a system according to the invention used to create a two-channel downmix from a five-channel source.
Figure 8:
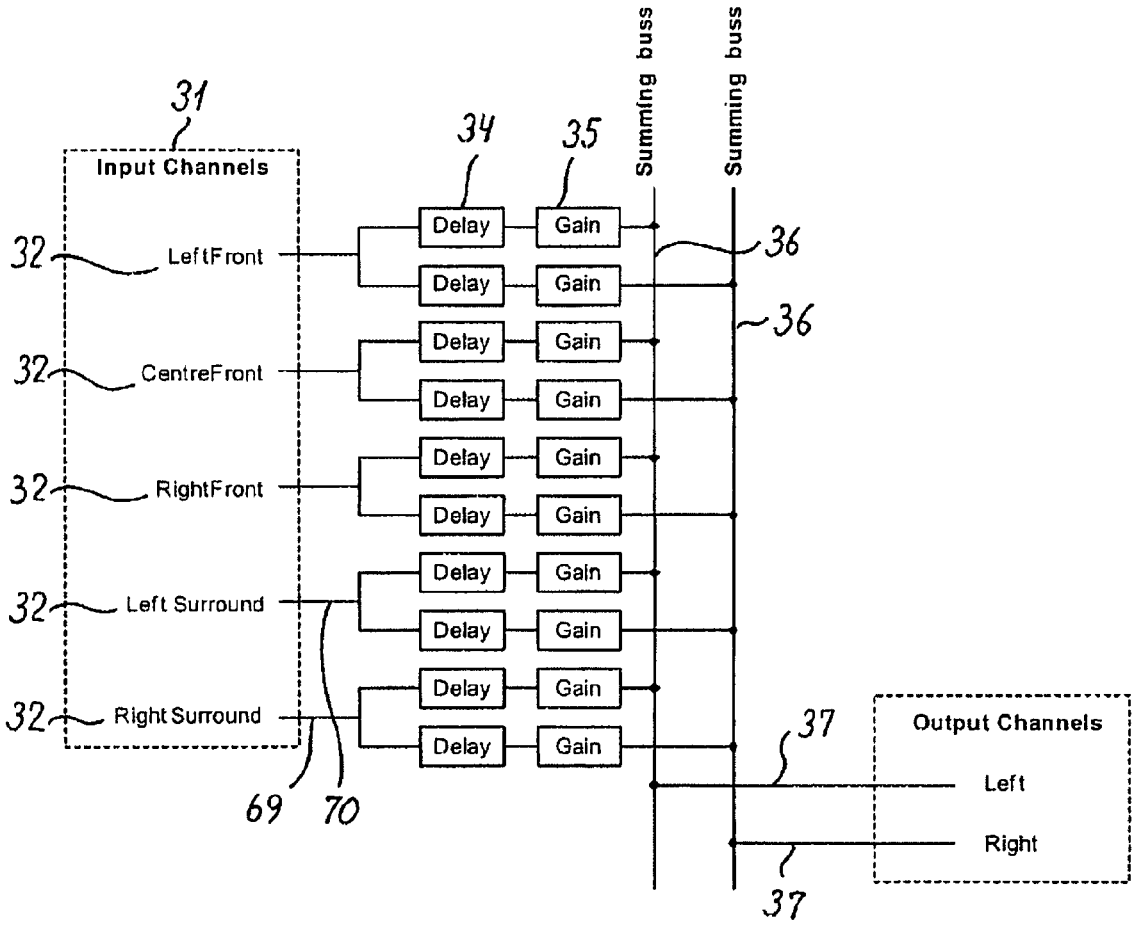
FIG. 8. A schematic block diagram showing the signal processing required to implement the system illustrated in FIG. 7.

With reference to FIGS. 7 and 8 there is shown an embodiment of a system according to the invention used to create a two-channel downmix from a five-channel source. The real loudspeakers 38 and 39 are placed in "incorrect" locations in a listening room. The virtual loudspeakers 1', 2', 3', 4' and 5' are each positioned in the appropriate locations in a virtual space near the real loudspeakers. Individual distances between the virtual loudspeakers and the real loudspeakers are calculated in two or three dimensions. For example, 40 is the distance between the virtual left loudspeaker 1' and the real left loudspeaker 39. 41 is the distance between the virtual left loudspeaker 1' and the real right loudspeaker 38. These two distances are used to determine the delay and gain of the signal from the left input channel to the left and right output channels sent to the real loudspeakers. Each input channel is assigned an appropriately calculated delay and gain for each output channel and these modified inputs are summed and sent to each loudspeaker.

Referring to FIG. 8 there is shown a schematic block diagram showing the signal processing required to implement the system illustrated in FIG. 7. Each delay and gain is individually calculated according to the distance relationship between the virtual loudspeakers associated with each input channel and the real loudspeakers associated with the output channels. A five-channel signal source 31 comprising five channels 32 (Left Front, Centre Front, Right Front, Left Surround and Right Surround) delivers input signals to the corresponding delay and gain means 34, 35 and the output signals from these are summed as described above in summing busses 36, whereby the required two output signals 37 for the real loudspeakers 38 and 39 are provided.

Figure 9:
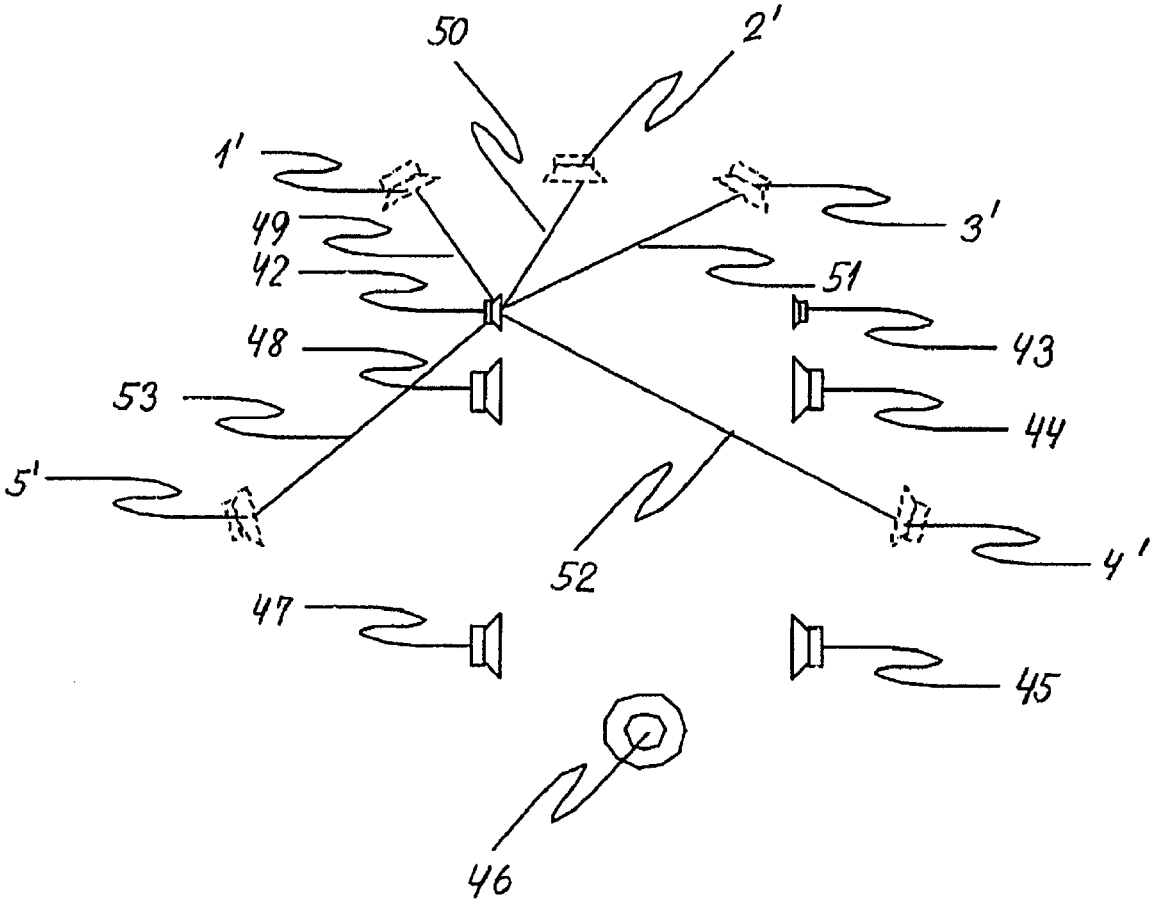
FIG. 9. An embodiment of the system according to the invention used as an upmix algorithm in an automotive audio system.

Referring to FIG. 9 there is shown an embodiment of the system according to the invention used as an upmix algorithm in an automotive audio system. The real loudspeakers are indicated in solid lines (42—front left tweeter, 48—front left woofer, 47—back left full-range, 43—front right tweeter, 44—front right woofer, 45—back right full-range, 46—subwoofer). The virtual loudspeakers are shown in dotted lines indicated by reference numerals 1', 2', 3', 4' and 5'. Each individual distance from a given virtual loudspeaker to a real loudspeaker is calculated and shown as an example for one real loudspeaker 42 as indicated by 53, 49, 50, 51 and 52, respectively. These distances are calculated for all virtual loudspeaker-to-real loudspeaker pairs.

Figure 10:
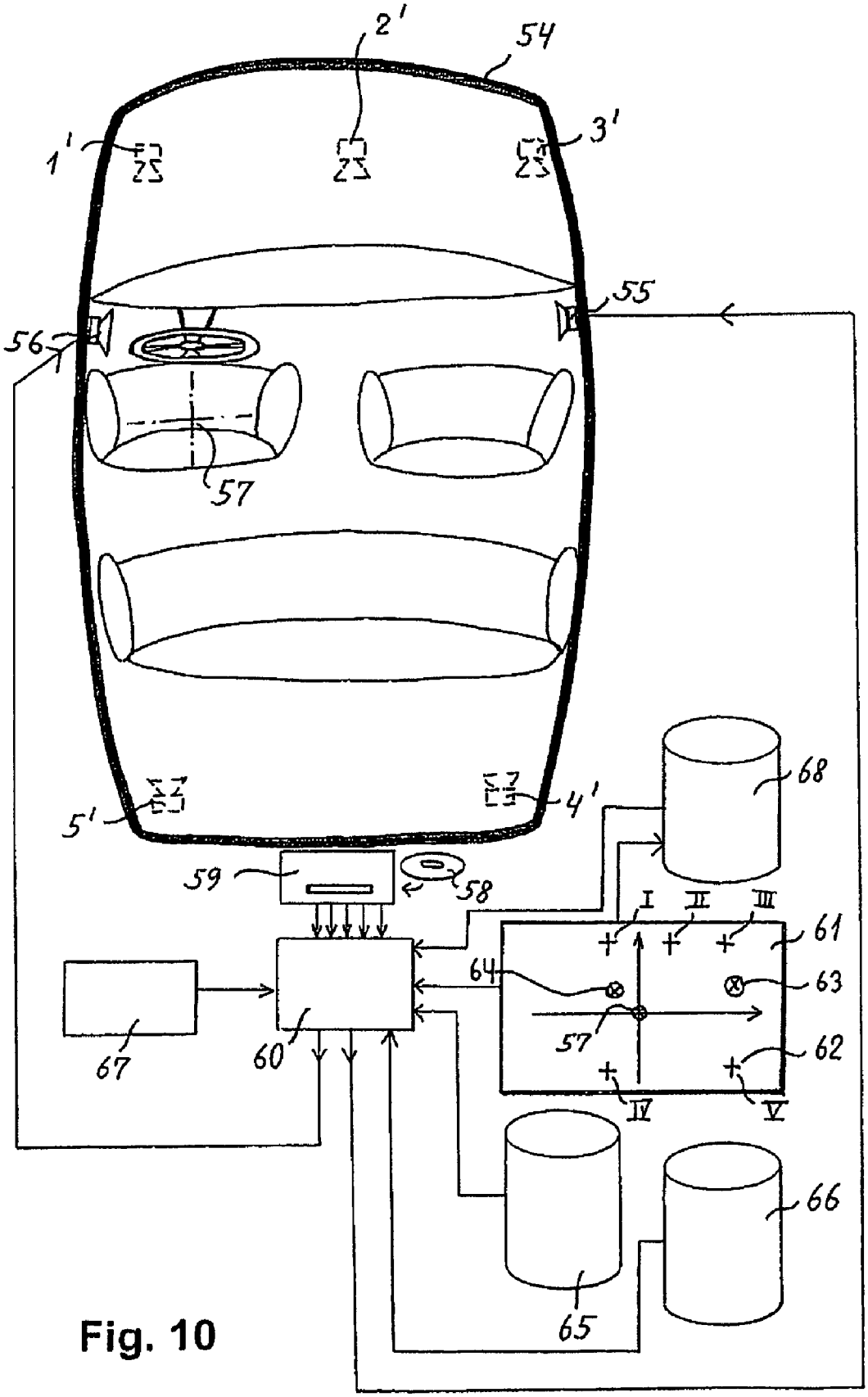
FIG. 10. A schematic representation of an implementation of a system in a car using the method and apparatus according to the present invention.

With reference to FIG. 10 there is shown a schematic representation of an implementation of a system in a car using the method and apparatus according to the present invention. The figure shows a car 54 provided with left and right loudspeakers 55, 56 for instance mounted in the left and right front doors of the car. The car is provided with a five-channel playback device 59 for playback of five-channel surround sound recorded on a suitable medium 58 such as a CD or DVD. The five output channels from the playback device 59 delivers five input signals to a downmix apparatus 60 according to the invention, and the two output channels from this apparatus are fed to the left and right loudspeakers 55 and 56, respectively. The downmix apparatus in this implementation thus provides a downmix from the five channels of audio delivered by the playback device 60 to the two real loudspeakers 55 and 56. By this process, the signals corresponding to the five virtual loudspeakers 1', 2', 3', 4' and 5' are provided.

In order to program the apparatus, X, Y, Z coordinates 63, 64 of the real loudspeakers 55, 56 and X, Y, Z coordinates I, II, III, IV, V of the virtual loudspeakers 1', 2', 3', 4', 5' are entered by means of a suitable user interface, for instance by the touch screen device 61 schematically shown in FIG. 10. Many other interfaces are possible in a practical set-up. The coordinates of the real and/or virtual loudspeakers may be stored in storage means 68, thus facilitating re-programming of the apparatus for instance if changes of the actual set-up of loudspeakers are made. The total system as shown in FIG. 10 may furthermore comprise storage means 65 for storing directional characteristics of the various real and/or virtual loudspeakers and storage means 66 for storing head-related transfer functions HRTF if such functions are to be incorporated into the method and apparatus according to the invention. Also a user-operated width control 67 (or rotation-control as mentioned in the summary of the invention) may be provided for the purpose described below. It is understood that further or alternative user interfaces may be provided without departing from the present invention.

Figure 11:
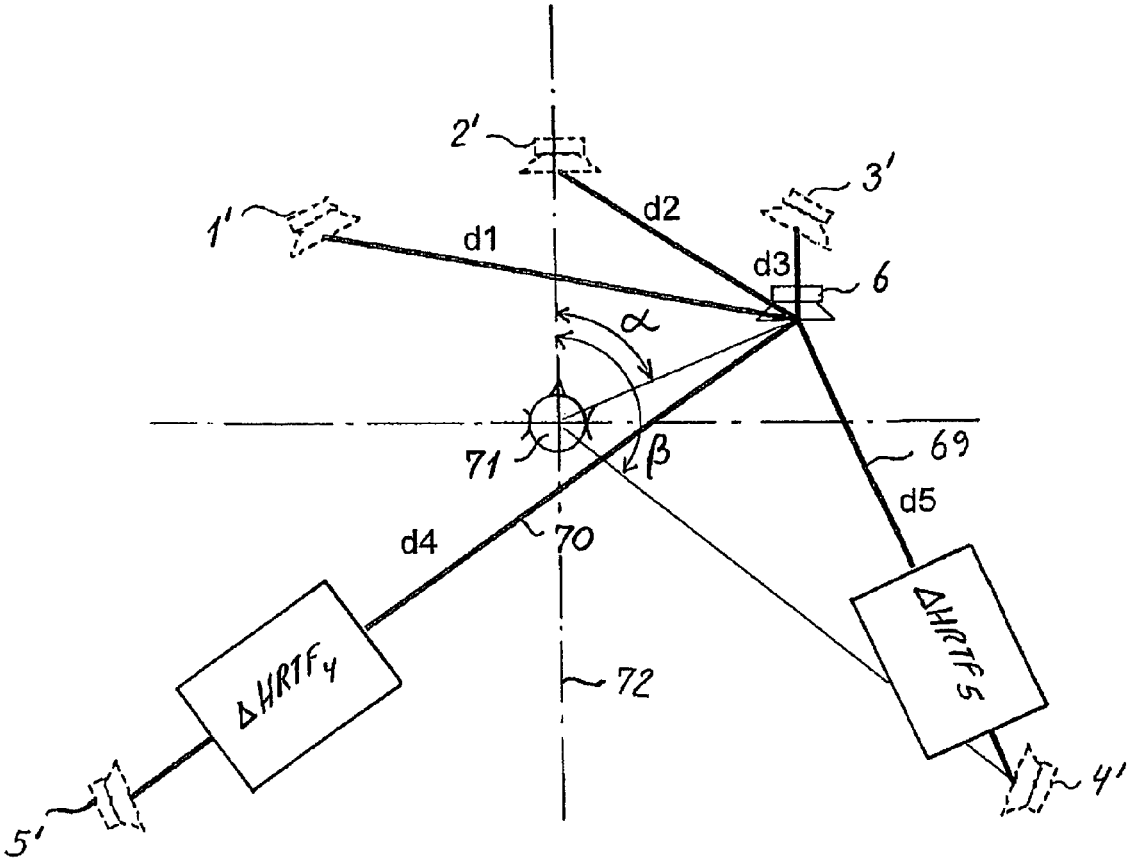
FIG. 11. A schematic representation of a system according to the invention comprising functions representing the differences between two head-related transfer functions.

With reference to FIG. 11 there is shown a schematic representation of an embodiment of the method/apparatus according to the invention comprising functions representing the differences between two head-related transfer functions. In order to obtain a clear perception of the virtual loudspeakers 4' and 5', which in a surround sound loudspeaker set-up will be located behind the listener 71 generated by sound reproduction from one or more loudspeakers actually located in front of the listener (real loudspeaker 6 in FIG. 11), differences between the HRTFs corresponding to the direction to the desired (virtual) loudspeaker and the real loudspeaker may be incorporated in the corresponding processing pathways ($d_4$ and $d_5$ in FIG. 11). According to this embodiment of the invention, the perception of the sound image of the surround loudspeakers 4' and 5' as actually being located behind the listener is enhanced by head-related corrections $\Delta HRTF_4$ and $\Delta HRTF_5$ applied to the corresponding gain and delay channels (69 and 70 in FIG. 8). The functions $\Delta HRTF_4$ and $\Delta HRTF_5$ are according to this embodiment defined by the equation:

$$\Delta HRTF_4=\Delta HRTF_5=HRTF(\beta)-HRTF(\alpha)$$

where it is assumed that the head-related transfer functions from the virtual loudspeakers 4' and 5' to the listener 71 are identical, which in principle will be true in this case, as the set-up is symmetrical with respect to the median plane through the listener 71 indicated by 72 in FIG. 11.

As mentioned above in connection with FIG. 10, a "width control" may be incorporated in the method/apparatus according to the invention. Thus, there exists the possibility of using the proposed method/apparatus to permit an end user to control the apparent "width" or "surround" content of an audio presentation. This can be accomplished by altering the locations of the virtual loudspeakers using a controller 67 (FIG. 10) presented to the end user. Increasing the "surround" or "width" amount, could, for example, increase the angle subtended by the virtual loudspeaker and a centre line. Decreasing the "width" amount would collapse the angles such that all virtual loudspeakers would be co-located with the front centre virtual loudspeaker. Also a rotation-effect of the sound field can be accomplished as mentioned previously.

The invention claimed is:

1. A method for converting n input signals to m output signals, comprising the steps of:

obtaining each of the output signals ($o_1, o_2, o_3, \ldots o_m$) as the sum of processed signals ($o_{11}, o_{12} \ldots o_{nm}$), where each of the processed signals is obtained by processing corresponding input signals ($i_1, i_2, \ldots i_n$) in a processing device having a transfer function $H_{ij}$ or an impulse response $h_{ij}$; and individually controlling and providing the output signals ($o_1, o_2, o_3, \ldots o_m$) to a number of real sound sources fixed relative to an environment by conversion of a set of the corresponding input signals ($i_1, i_2, \ldots i_n$) intended for a different number and configuration of virtual sound sources intended for the environment, characterized with the steps of representing the fixed real sound sources and the virtual sound sources in a vector space of the environment, supplying each particular fixed real sound source with the output signal ($o_1, o_2, o_3, \ldots o_m$) that is obtained as a linear sum of at least some of the input signals intended for the virtual sound sources, and providing these output signals with individually determined magnitudes and delays, where the magnitudes and delays are calculated by using the vectorial distances between each of the virtual sound sources and the particular fixed sound source in the environment.

2. A method according to claim 1, where said processing in said processing device comprises means for providing the corresponding input signals ($i_1, i_2, \ldots i_n$) with individually determined delays ($D_i$) or individually determined gain/attenuations ($g_i$), or both individually determined delays ($D_i$) and individually determined gain/attenuations ($g_i$).

3. A method according to claim 2, wherein for each pair of virtual sound sources corresponding to a given one of said input signals ($i_i, i_2, \ldots i_n$) and for real sound sources corresponding to a given one of said output signals ($_i$), the distance ($d_i$) between said virtual and real sound source is determined, and the corresponding gain ($g_i$) and delay ($D_i$) are determined by application of the equations:

$$g_i=1/d_i \text{ and } D_i=d_i/c$$

where c is the speed of sound in air.

4. A method according to claim 1, where the individual gain/attenuations $g_i$ or transfer functions $H_{ij}$ are functions $g_i(f)$, $H_{ij}$ of frequency (f).

5. A method according to claim 1, characterized in that the gain/attenuations and time delays are weighted according to the polar distribution of energy of each of the virtual sources, whereby the directional characteristics of the corresponding virtual sound sources can be simulated.

6. A method according to claim 5, characterized in that the polar distribution of energy is a pre-defined standard function applied essentially uniformly to all virtual sound sources.

7. A method according to claim 1, where the individual functions $g_i$, $g_i(f)$ and $D_i$ can be varied in order to change the perceived width of the sound image produced by the real sound sources or to rotate this image, when these sound sources are provided with the output signals ($o_1, o_2, o_3, \ldots o_m$) obtained by application of the method of any of the preceding claims.

8. A method according to claim 1, where at least one of said functions $H_{ij}(f)$ or $h_{ij}(t)$ characterizing said processing means comprises the head-related transfer function (HRTF) of the human ear or differences between such head-related transfer functions given by the equation:

$$\square HRTF=HRTF(\text{virtual sound source})-HRTF(\text{real sound source})$$

or the equivalent impulse responses.

9. The use of a method according to claim 1 for providing a set of automotive loudspeakers or loudspeakers in a yacht with signals corresponding to a home entertainment environment.

10. An apparatus for performing a conversion or upmix/downmix operation comprising:

(a) n input terminals for receiving input signals ($i_1, i_2, \ldots i_n$) from a suitable input source;

(b) processing means ($H_{11}, H_{12} \ldots H_{nm}$) for processing corresponding input signal ($i_1, i_2, \ldots i_n$), whereby each of the processing means provides a processed output signal ($o_{11}, o_{12} \ldots o_{nm}$);

(c) m summing means for providing m output signals ($o_1, o_2, o_3, \ldots o_m$);

where each of said summing means is provided with processed output signals ($o_{11}, o_{12}, \ldots o_{nm}$) corresponding to each of said input signals ($i_1, i_2, \ldots i_n$);

where each of said processing means ($H_{11}, H_{12} \ldots H_{nm}$) comprise delay means or gain means or both delay means and gain means, whereby each of said processed output signals ($o_{11}, o_{12}, o_{13}, \ldots o_{nm}$) will be a delayed version of the corresponding input signal or an amplified or attenuated version of the corresponding input signal or a delayed and amplified or attenuated version of the corresponding input signal;

(d) a data register for storing location coordinate information for each of a set of loudspeakers fixed relative to an environment and for each of a set of virtual loudspeakers intended for the environment;

(e) means for determining the numerical vectorial distance between each of the virtual loudspeakers and a particular fixed loudspeaker in the environment;

(f) means for storing said numerical vector distances in an intermediate result matrix;

(g) division means for determining the corresponding delays (D) by dividing the numerical distance by the speed of sound in air (c);

(h) means for determining the corresponding gains (q) by taking the reciprocal of said numerical vector distances;

(i) multiplier means for multiplying each of said input signals by the corresponding gain (g) and adder means for adding the corresponding delay (D); and (j) summing means for adding the processed signals corresponding to each virtual loudspeaker to obtain an output signal ($o_1, o_1, o_1, \ldots o_m$), for each of said loudspeakers in the environment.

11. An apparatus according to claim 10, further comprising a series of A/D converter means for receiving input signals corresponding to the virtual loudspeakers and converting them to a digital representation; and wherein said summing means includes a signal to a D/A converter.

12. The use of an apparatus according to claim 10 for providing a set of automotive loudspeakers or loudspeakers in a yacht with signals corresponding to a home entertainment environment.

* * * * *